US006520428B1

(12) United States Patent
Elam

(10) Patent No.: US 6,520,428 B1
(45) Date of Patent: Feb. 18, 2003

(54) FOAM GUN HANDLE EXTENSION ATTACHMENT

(76) Inventor: Randolph J. Elam, 1770 W. 7th, Reno, NV (US) 89502

( * ) Notice: Subject to any disclaimer, the term of this patent is extended or adjusted under 35 U.S.C. 154(b) by 0 days.

(21) Appl. No.: 09/917,158

(22) Filed: Jul. 27, 2001

(51) Int. Cl.[7] ..... B05B 15/06
(52) U.S. Cl. ..... 239/532; 239/578; 239/525
(58) Field of Search ..... 239/532, 280, 239/280.5, 281, 587.1, 587.5, 578, 525

(56) References Cited

U.S. PATENT DOCUMENTS

| | | | | | |
|---|---|---|---|---|---|
| 299,096 | A | * | 5/1884 | Winter | 222/113 |
| 1,627,250 | A | * | 5/1927 | Parker | 239/455 |
| 3,069,095 | A | * | 12/1962 | Bishop | 222/164 |
| 3,949,817 | A | | 4/1976 | Rice | |
| 3,985,188 | A | | 10/1976 | Steele | |
| 4,023,711 | A | | 5/1977 | Sena | |
| 4,744,519 | A | | 5/1988 | Crowley | |
| 5,485,960 | A | | 1/1996 | Troudt | |
| D378,983 | S | | 4/1997 | Nall | |

* cited by examiner

*Primary Examiner*—Christopher Kim

(57) ABSTRACT

A foam gun handle extension attachment for allowing a foam gun to be used more easily and effectively in high or hard-to-reach places. The foam gun handle extension attachment includes an elongate tubular member being adapted to be removably attached to a hose for a foam gun; and also includes an elbow tubular member having a first end and a second end which is removably attached to the elongate tubular member; and further includes a tubular connector having a first end portion and a second end which is removably attached to the first end of the elbow tubular member; and also includes a trigger assembly being adapted to be connected to a gun trigger of the foam gun for allowing foam to be dispensed through the foam gun.

9 Claims, 2 Drawing Sheets

FOAM GUN HANDLE EXTENSION ATTACHMENT

BACKGROUND OF THE INVENTION

1. Field of the Invention

The present invention relates to a gun handle extension and more particularly pertains to a new foam gun handle extension attachment for allowing a foam gun to be used more easily and effectively in high or hard-to-reach places.

2. Description of the Prior Art

The use of a gun handle extension is known in the prior art. More specifically, a gun handle extension heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,023,711; 4,744,519; 5,485,960; 3,985,188; 3,949,817; and U.S. Pat. No. Des. 378,983.

While these devices fulfill their respective, particular objectives and requirements, the aforementioned patents do not disclose a new foam gun handle extension attachment. The inventive device includes an elongate tubular member being adapted to be removably attached to a hose for a foam gun; and also includes an elbow tubular member having a first end and a second end which is removably attached to the elongate tubular member; and further includes a tubular connector having a first end portion and a second end which is removably attached to the first end of the elbow tubular member; and also includes a trigger assembly being adapted to be connected to a gun trigger of the foam gun for allowing foam to be dispensed through the foam gun.

In these respects, the foam gun handle extension attachment according to the present invention substantially departs from the conventional concepts and designs of the prior art, and in so doing provides an apparatus primarily developed for the purpose of allowing a foam gun to be used more easily and effectively in high or hard-to-reach places.

SUMMARY OF THE INVENTION

In view of the foregoing disadvantages inherent in the known types of gun handle extension now present in the prior art, the present invention provides a new foam gun handle extension attachment construction wherein the same can be utilized for allowing a foam gun to be used more easily and effectively in high or hard-to-reach places.

The general purpose of the present invention, which will be described subsequently in greater detail, is to provide a new foam gun handle extension attachment which has many of the advantages of the gun handle extension mentioned heretofore and many novel features that result in a new foam gun handle extension attachment which is not anticipated, rendered obvious, suggested, or even implied by any of the prior art gun handle extension, either alone or in any combination thereof.

To attain this, the present invention generally comprises an elongate tubular member being adapted to be removably attached to a hose for a foam gun; and also includes an elbow tubular member having a first end and a second end which is removably attached to the elongate tubular member; and further includes a tubular connector having a first end portion and a second end which is removably attached to the first end of the elbow tubular member; and also includes a trigger assembly being adapted to be connected to a gun trigger of the foam gun for allowing foam to be dispensed through the foam gun.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foam gun handle extension attachment which has many of the advantages of the gun handle extension mentioned heretofore and many novel features that result in a new foam gun handle extension attachment which is not anticipated, rendered obvious, suggested, or even implied by any of the prior art gun handle extension, either alone or in any combination thereof.

It is another object of the present invention to provide a new foam gun handle extension attachment which may be easily and efficiently manufactured and marketed.

It is a further object of the present invention to provide a new foam gun handle extension attachment which is of a durable and reliable construction.

An even further object of the present invention is to provide a new foam gun handle extension attachment which is susceptible of a low cost of manufacture with regard to both materials and labor, and which accordingly is then susceptible of low prices of sale to the consuming public, thereby making such foam gun handle extension attachment economically available to the buying public.

Still yet another object of the present invention is to provide a new foam gun handle extension attachment which provides in the apparatuses and methods of the prior art some of the advantages thereof, while simultaneously overcoming some of the disadvantages normally associated therewith.

Still another object of the present invention is to provide a new foam gun handle extension attachment for allowing a foam gun to be used more easily and effectively in high or hard-to-reach places.

Yet another object of the present invention is to provide a new foam gun handle extension attachment which includes an elongate tubular member being adapted to be removably attached to a hose for a foam gun; and also includes an elbow tubular member having a first end and a second end which is removably attached to the elongate tubular member; and further includes a tubular connector having a first end portion and a second end which is removably attached to the first end of the elbow tubular member; and also includes a trigger assembly being adapted to be connected to a gun trigger of the foam gun for allowing foam to be dispensed through the foam gun.

Still yet another object of the present invention is to provide a new foam gun handle extension attachment that allows the user to reach areas without having to use a ladder.

Even still another object of the present invention is to provide a new foam gun handle extension attachment that can be easily and quickly attached to an existing foam gun and foam hose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
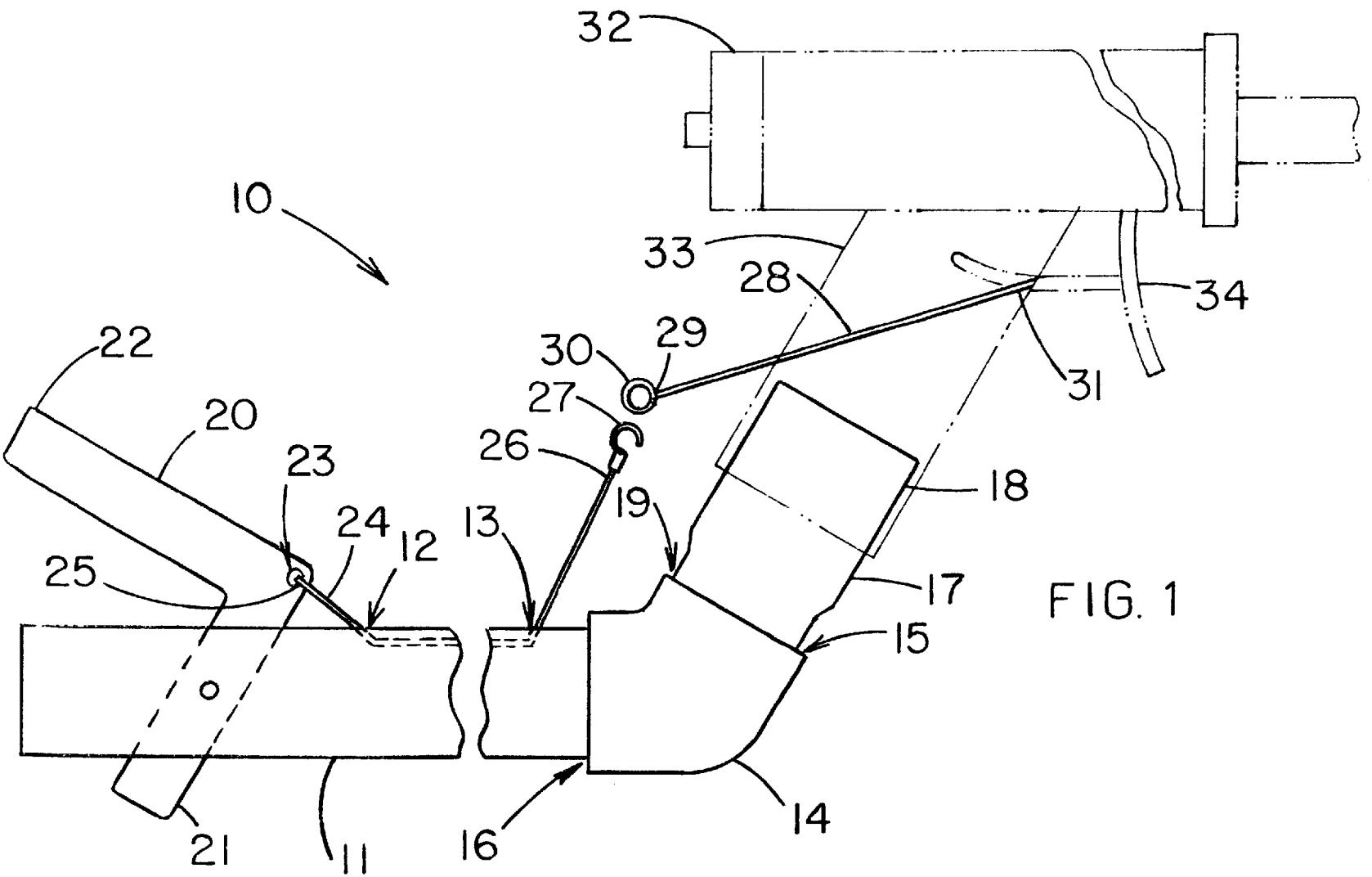
FIG. 1 is a side elevational view of a new foam gun handle extension attachment according to the present invention.
Figure 2:
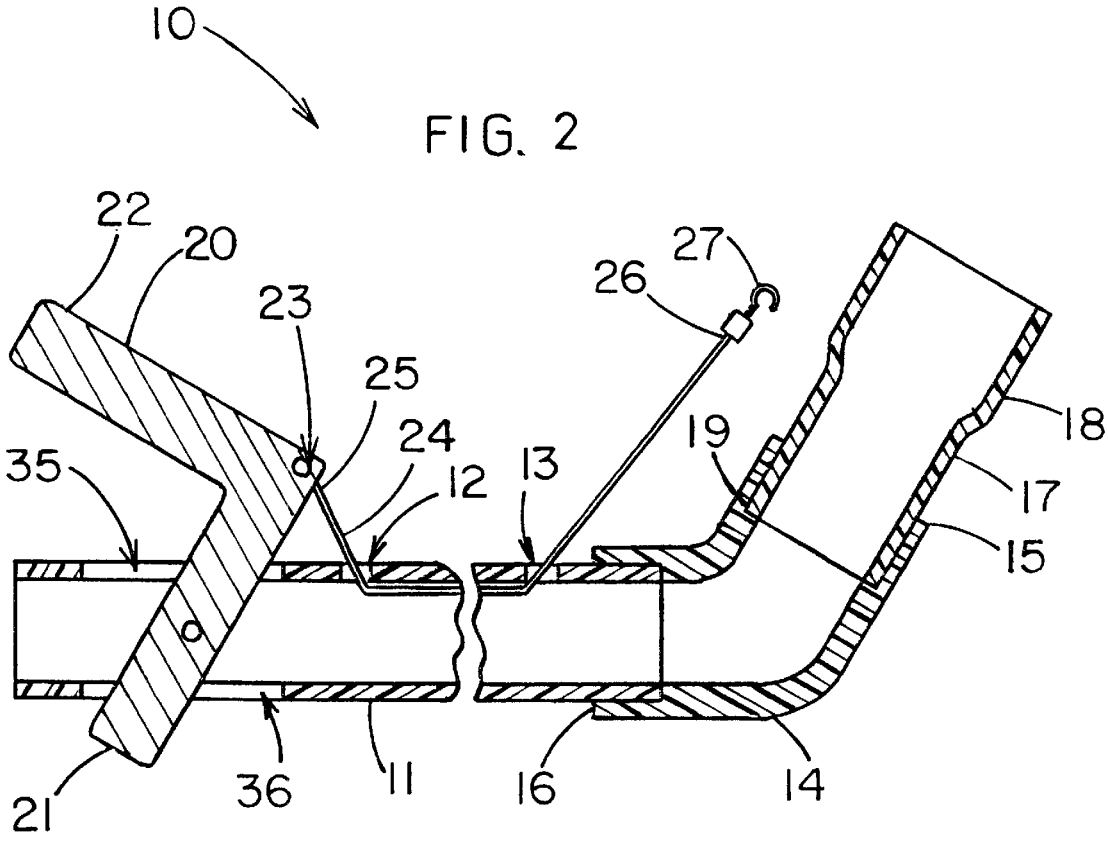
FIG. 2 is a cross-sectional view of the present invention.

With reference now to the drawings, and in particular to FIGS. 1 through 2 thereof, a new foam gun handle extension attachment embodying the principles and concepts of the present invention and generally designated by the reference numeral 10 will be described.

As best illustrated in FIGS. 1 through 2, the foam gun handle extension attachment 10 generally comprises an elongate tubular member 11 having a length of approximately 3 feet; and also comprises an elbow tubular member 14 having a first end 15 and a second end 16 which is removably and conventionally attached to the elongate tubular member 11. The elongate tubular member 11 has an end which is removably received in the second end 16 of the elbow tubular member 14, and also has holes 15,16 being spaced apart and being disposed through a wall thereof with the elbow tubular member 11 being angled approximately 45 degrees.

A tubular connector 17 has a first end portion 18 and a second end 19 which is removably and conventionally attached to the first end 15 of the elbow tubular member 14. The first end portion 18 of the tubular connector 17 is flared relative to the second end 19 thereof and is adapted to be removably received in an end of a foam gun handle 33 of the foam gun 32. The tubular connector 17 has a length of approximately 3 inches.

A trigger assembly is adapted to be connected to a foam gun trigger 34 of the foam gun 32 for allowing foam to be dispensed through the foam gun 32. The trigger assembly includes an L-shaped trigger member 20 being pivotally and conventionally attached to the elongate tubular member 11, and also includes a first flexible line 24 being conventionally connected to the L-shaped trigger member 20 and extending in one of the holes 12 in the elongate tubular member 11 and out of another of the holes 13 of the elongate tubular member 11, and further includes a second flexible line 28 which is conventionally connected to the first flexible line 24 and which is adapted to be connected to the foam gun trigger 34. The L-shaped trigger member 20 includes a first portion 21 having a center which is pivotally attached to the elongate tubular member 11, and also includes a second portion 22 which is adapted to be grasped by a user for pivoting the L-shaped trigger member 20, and further includes a hole 23 being disposed therethrough. The first flexible line 24 includes a first end 25 which is securely and conventionally attached and tied at and extended through the hole 23 of the L-shaped trigger member 20, and also includes a second end 26 having a hook member 27 securely and conventionally attached thereto. The second flexible line 28 includes a first end 29 which has an eyelet 30 securely and conventionally attached thereto, and also includes a second end 31 which is adapted to be securely and conventionally attached to the foam gun trigger 34. The hook member 27 of the first flexible line 24 is connected to the eyelet 30 of the second flexible line 28. The hole 23 in the L-shaped trigger member 20 is disposed at a corner of where the first and second portions 21,22 are integrally joined. The elongate tubular member 11 also includes two enlarged holes 35,36 being diametrically disposed through the wall thereof with the first portion 21 of the L-shaped trigger member 20 being pivotally disposed through the enlarged holes 35,36.

In use, the user grasps and pivots the second portion 22 of the L-shaped trigger member 20 which, in turn, pivots the foam gun trigger 34 to allow the foam to be dispensed through the foam gun 32 without the user having to directly grasp the foam gun trigger 34.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foam gun handle extension attachment comprising:

an elongate tubular member having a first end and a second end, said elongate tubular member having a pair of enlarged holes being diametrically disposed through said wall thereof and being positioned adjacent to said first end of said elongate tubular member;

an elbow tubular member having a first end and a second end, said second end of said elbow tubular member being removably attached to said second end of said elongate tubular member;

a tubular connector having a first end portion and a second end which is removably attached to said first end of said elbow tubular member;

a trigger assembly being adapted to be connected to a foam gun trigger of the foam gun for allowing foam to be dispensed through the foam gun;

said trigger assembly including an L-shaped trigger member being pivotally attached to said elongate tubular member and being positioned adjacent to said first end of said elongate tubular member, said trigger member comprising a first portion and a second portion; and said first portion of said trigger member having a center being pivotally coupled to said elongate tubular member, said first portion of said L-shaped trigger member being pivotally disposed through said enlarged holes of said elongate tubular member in a manner such that each of said portions of said trigger member extend outward from said elongate tubular member for the purpose of actuating the trigger of the foam gun.

2. A foam gun handle extension attachment as described in claim 1, wherein said elongate tubular member has openings being spaced apart and being disposed through a wall thereof, each of said holes being positioned proximate said second end of said elongate tubular member.

3. A foam gun handle extension attachment as described in claim 2, wherein said first end portion of said tubular connector is flared relative to said second end thereof and is adapted to be removably received in an end of a foam gun handle of the foam gun.

4. A foam gun handle extension attachment as described in claim 2, wherein said trigger assembly includes a first flexible line being connected to said L-shaped trigger member and extending in one of said openings in said elongate tubular member and out of another of said openings of said elongate tubular member; and said trigger assembly including a second flexible line being selectively couplable to said first flexible line and being adapted to be connected to the foam gun trigger.

5. A foam gun handle extension attachment as described in claim 4, wherein said trigger member includes a hole being disposed therethrough for attaching said first flexible line thereto.

6. A foam gun handle extension attachment as described in claim 5, wherein said first flexible line includes a first end which is securely attached at and extended through said hole of said L-shaped trigger member, and also includes a second end having a hook member securely attached thereto.

7. A foam gun handle extension attachment as described in claim 6, wherein said second flexible line includes a first end which has an eyelet securely attached thereto, and also includes a second end which is adapted to be securely attached to the foam gun trigger, said hook member of said first flexible line being connected to said eyelet of said second flexible line.

8. A foam gun handle extension attachment as described in claim 7, wherein said hole in said L-shaped trigger member is disposed at a corner of where said first and second portions are integrally joined.

9. A foam gun handle extension attachment comprising:

an elongate tubular member having a length of approximately 3 feet;

an elbow tubular member having a first end and a second end which is removably attached to said elongate tubular member, said elongate tubular member having an end which is removably received in said second end of said elbow tubular member, and also having openings being spaced apart and being disposed through a wall thereof, said elbow tubular member being angled approximately 45 degrees;

a tubular connector having a first end portion and a second end which is removably attached to said first end of said elbow tubular member, said first end portion of said tubular connector being flared relative to said second end thereof and being adapted to be removably received in an end of a foam gun handle of the foam gun, said tubular connector having a length of approximately 3 inches; and a trigger assembly being adapted to be connected to a foam gun trigger of the foam gun for allowing foam to be dispensed through the foam gun, said trigger assembly including an L-shaped trigger member being pivotally attached to said elongate tubular member, and also including a first flexible line being connected to said L-shaped trigger member and extending in one of said openings in said elongate tubular member and out of another of said openings of said elongate tubular member, and further including a second flexible line which is connected to said first flexible line and which is adapted to be connected to the foam gun trigger;

said trigger assembly including an L-shaped trigger member being pivotally attached to said elongate tubular member, said trigger member comprising a first portion and a second portion, said first portion of said trigger member having a center being pivotally coupled to said elongate tubular member, said first portion of said L-shaped trigger member being pivotally disposed through said enlarged holes of said elongate tubular member in a manner such that each of said portions of said trigger member extend outward from said elongate tubular member for the purpose of actuating the trigger of the foam gun, said trigger member including a hole being disposed therethrough, said first flexible line including a first end which is securely attached at and extended through said hole of said L-shaped trigger member, and also including a second end having a hook member securely attached thereto, said second flexible line including a first end which has an eyelet securely attached thereto, and also including a second end which is adapted to be securely attached to the foam gun trigger, said hook member of said first flexible line being connected to said eyelet of said second flexible line, said hole in said L-shaped trigger member being disposed at a corner of where said first and second portions are integrally joined, said elongate tubular member also including two enlarged holes being diametrically disposed through said wall thereof, said first portion of said L-shaped trigger member being pivotally disposed through said enlarged holes.

* * * * *